US007578161B1

(12) United States Patent
Sizemore

(10) Patent No.: US 7,578,161 B1
(45) Date of Patent: Aug. 25, 2009

(54) PNEUMATICALY DRIVEN PIPE SWEDGING AND FLARING TOOLS

(76) Inventor: Marion M. Sizemore, 1975 Copenhaver Rd., Ft. Pierce, FL (US) 34945

( * ) Notice: Subject to any disclaimer, the term of this patent is extended or adjusted under 35 U.S.C. 154(b) by 0 days.

(21) Appl. No.: 12/175,460

(22) Filed: Jul. 18, 2008

(51) Int. Cl.
*B21J 13/02* (2006.01)
*B21D 19/00* (2006.01)

(52) U.S. Cl. ..... 72/479; 72/317; 72/318; 72/370.01; 72/370.06; 72/370.11; 72/393; 29/890.043; 29/890.044

(58) Field of Classification Search ..... 72/75, 72/297, 317, 318, 370.1, 370.6, 370.7, 370.11, 72/393, 479; 29/890.043, 890.044
See application file for complete search history.

(56) References Cited

U.S. PATENT DOCUMENTS 1,930,825 A * 10/1933 Raymond ..... 72/75
2,679,681 A * 6/1954 Resler ..... 72/370.06
3,380,285 A * 4/1968 Wilson ..... 72/370.07
3,504,515 A * 4/1970 Reardon ..... 72/479
4,512,178 A * 4/1985 Blevins et al. ..... 72/393
4,573,340 A * 3/1986 Kammeraad ..... 72/479
5,189,900 A * 3/1993 Colvin et al. ..... 72/479
6,695,065 B2 * 2/2004 Simpson et al. ..... 72/297

* cited by examiner

*Primary Examiner*—David B Jones
(74) *Attorney, Agent, or Firm*—Mark Young, P.A.

(57) ABSTRACT

Tools for expanding (i.e., flaring and swedging) the ends of metal tubes are configured for attachment to a powered impact hammer, such as an air hammer. A swedging tool for swedging an end of a metal tube has a swedging body with a die section for expanding the tube when driven thereinto and a flanged shank attached to the swedging body and configured for engagement by a powered impact hammer. A flaring tool for flaring an end of a metal tube includes a flaring body having a die section for flaring the tube when driven thereinto. A flanged shank is attached to the flaring body and configured for engagement by a powered impact hammer. A method for expanding an end of a metal tube entails attaching a die body for expanding the end of the metal tube to a powered impact hammer, aligning the die body with the inner diameter of the metal tube, activating the powered impact hammer, and urging the die body a determined distance into the metal tube.

12 Claims, 10 Drawing Sheets

PNEUMATICALY DRIVEN PIPE SWEDGING AND FLARING TOOLS

FIELD OF THE INVENTION

This invention relates to pipe fitting, and more particularly, to pipe swedging and flaring tools adapted for use with an air hammer and configured to expand the end of a first length of metal tube for connecting the expanded end to a second length of metal tube by receiving a portion of the second length in the expanded end of the first length.

BACKGROUND

Pipe fitting is necessary in many different trades, including, but not limited to plumbing, HVAC, refrigeration, manufacturing, fire prevention, and many others. Among the most widely used metal pipe is copper tubing, which is favored for its abundance, ductility and high resistance to corrosion, Copper tubing is most often used for supply of hot and cold water, and as a refrigerant line in HVAC and refrigeration systems. Copper tubing is typically joined using a flare connection, compression connection, crimp fitting, sweat (i.e., solder) or swedge.

Flare connections require that the end of a tubing section be spread outward in a bell shape using a flare tool. A flare nut then compresses this bell-shaped end onto a male fitting. Flare connections are labor intensive but are quite reliable over the course of many years.

Sweat fittings are smooth couplings that easily slip onto the end of a tubing section. The joint is then heated using a torch, and solder is melted into the connection. When the solder cools, it forms a very strong bond.

Compression fittings use a soft metal ring (i.e., a compression ring) which is squeezed onto the pipe and into the fitting by a compression nut. The soft metal ring conforms to the surface of the tubing and the fitting, and creates a seal. Compression connections are time consuming to make and sometimes require retightening over time to stop leaks.

Crimped or pressed connections use special copper fittings which are permanently attached to rigid copper tubing with a powered crimper. The fittings, manufactured with sealant already inside, slide over the tubing to be connected. Substantial pressure is exerted to deform the fitting and compress the sealant against the inner copper tubing, creating a water tight seal.

Swedging is a metal-forming technique in which a receiving end of a tube is precisely expanded using a die. The mating end of another tube is inserted into the expanded end. The joint is then heated using a torch, and solder is melted into the connection. When the solder cools, it forms a very strong bond.

There are many examples of swedging tools known in the prior art. For example, U.S. Pat. No. 2,679,681 to Resler discloses a swedging method. After thinning (i.e., counterboring) the wall of the end of a length of tubing by drilling, the tubing is firmly held by clamping as a punch is urged into the counterbored section. Not only is counterboring time consuming, but it is imprecise and conducive to uneven thinning or damaging of the wall. Also, Resler provides no means to facilitate rapid and repeatable urging of the punch into the thinned wall section.

As another example, U.S. Pat. No. 3,380,285 to Wilson discloses an assembly of nested swedging tools of various sizes for covering a wide range of tubing diameters. To expand a pipe, a chosen swedging tool is driven by hammer blows. The tool requires manual strikes which tend to be inconsistent, off-centered and tedious, especially for a professional who may have to join many tubing sections in a work day.

As yet another example, U.S. Pat. No. 5,046,349 to Velte discloses a lever-actuated expander with means to grip a pipe and urge a conical mandrel into the open end of the pipe for expansion. Actuation is limited by the manual gripping force of a user. Setting the tube up for use is tedious. Slippage results in an imperfect flaring.

What is needed is an easy to use, consistently reliable, powered tool for swedging or flaring the end of tubing for joining to like tubing. The tool should be configured to work with existing air or electric powered impact equipment. The invention is directed to overcoming one or more of the problems and solving one or more of the needs as set forth above.

SUMMARY OF THE INVENTION

To solve one or more of the problems set forth above, in an exemplary implementation of the invention, tools for expanding (i.e., flaring and swedging) the ends of metal tubes are provided. The tools are configured for attachment to a powered impact hammer, such as an air hammer. A method for expanding the ends of metal tubes using such a tool and a powered impact hammer is also provided.

In one aspect of the invention, a swedging tool for expanding an end of a first metal tube having a first inner diameter and a first outer diameter is provided. The tool includes a swedging body having a die section for expanding a tube of predetermined diameter when driven thereinto and a flanged shank attached to the swedging body and configured for engagement by a powered impact hammer. A key feature of the tool is that it is adapted for attachment to a powered impact hammer, such as an air hammer.

The flanged shank is configured for engagement by a retainer spring of a powered impact hammer. The flanged shank has a cylindrical proximal shank body sized for engagement by a powered impact hammer, a distal shank body, and a flange disposed therebetween. The flange has a chamfered trailing edge and a leading edge substantially perpendicular to a longitudinal axis of the swedging tool. The proximal shank body has a diameter of about 0.40 inches. The distal shank body has a diameter of about 0.50 inches. The flange has a diameter of about 0.80 inches. In one embodiment, the flanged shank is threadedly connected to the swedging body. In other embodiments, the flanged shank is integrally formed and permanently connected to the swedging body.

In one embodiment, the die section includes a cylindrical first body section having a diameter that is approximately equal to the first inner diameter of the first metal tube, and a cylindrical second body section having a diameter that is approximately equal to the first outer diameter of the first metal tube, and a first chamfered transition from the first body section to the second body section. In another embodiment, the swedging tool is further configured to expand an end of a second metal tube having a second inner diameter and a second outer diameter. Thus, the die section further includes a cylindrical third body section having a diameter that is about equal to the second outer diameter of the second metal tube, and the cylindrical second body section having a diameter that is about equal to the second inner diameter the second metal tube, and a second chamfered transition from the second body section to the third body section.

In another embodiment, the swedging tool is further configured to expand an end of a third metal tube having a third inner diameter and a third outer diameter. The die section further includes a cylindrical fourth body section having a diameter that is about equal to the third outer diameter of the third metal tube. The cylindrical third body section has a diameter that is about equal to the third inner diameter the third metal tube. A third chamfered transition provides a transition from the third body section to the fourth body section.

In another aspect of the invention, a flaring tool for flaring an end of a first metal tube having a first inner diameter and a first outer diameter is provided. The tool includes a flaring body having a die section for flaring a tube of predetermined diameter when driven thereinto. A flanged shank is attached to the flaring body and configured for engagement by a powered impact hammer. The flanged shank, which is configured for engagement by a retainer spring of a powered impact hammer, has a cylindrical proximal shank body sized for engagement by a powered impact hammer, a distal shank body, and a flange disposed therebetween.

In yet another aspect of the invention, a method for expanding an end of a metal tube having an inner diameter and an outer diameter is provided. The method includes steps of attaching a die body for expanding the end of the metal tube to a powered impact hammer, aligning the die body with the inner diameter of the metal tube, activating the powered impact hammer, and urging the die body a determined distance into the metal tube. The die body is either a swedging body having a die section for swedging the end of the metal tube and a flanged shank attached to the swedging body and configured for engagement by a powered impact hammer, or a flaring body having a die section for flaring the end of the metal tube and a flanged shank attached to the flaring body and configured for engagement by a powered impact hammer.

BRIEF DESCRIPTION OF THE DRAWINGS

The foregoing and other aspects, objects, features and advantages of the invention will become better understood with reference to the following description, appended claims, and accompanying drawings, where:

Figure 1A:
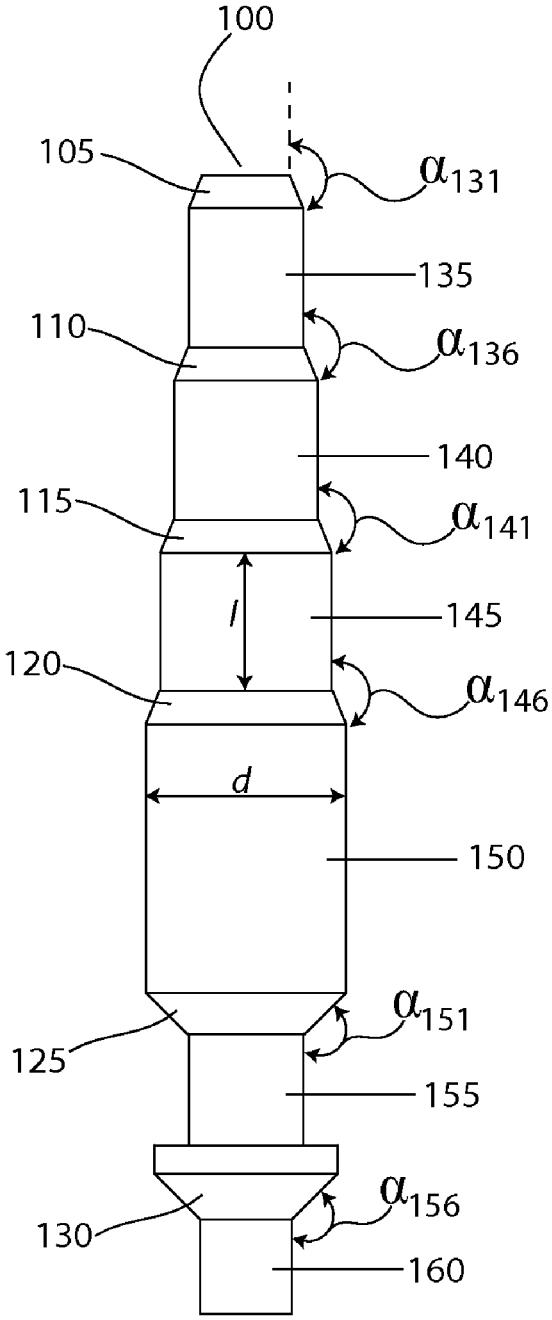
FIG. 1A shows a profile of a first exemplary pipe swedging tool for an air hammer according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the types of power tools, relative sizes, ornamental aspects or proportions shown in the figures.

DETAILED DESCRIPTION

Referring to the Figures, in which like parts are indicated with the same reference numerals, various views of exemplary pipe swedging and flaring tools for an air hammer according to principles of the invention are shown. Each tool has one or more swedging or flaring sections, each section being for a tube of a particular size. Each tool also has a shank adapted for releasable connection to an impact hammer, such as an air or electric powered impact hammer with a spring retainer or collet. Each tool has a tapered leading edge, a body section having a diameter equal to or slightly less than the inner diameter of the tubing, and a metal forming section configured to flare or swedge the tubing as the tool is advanced into the tubing. The tools are preferably comprised of hardened steel or other material suitable for withstanding the repetitive stresses and strains encountered in the operating environment.

The tools described herein are designed to expand metal pipes or tubes. The terms pipes and tubes are used herein synonymously to mean an elongated hollow fluid carrying means with an inner diameter and an outer diameter. Dimensions provided herein are provided as examples. Some features are designed to fit within the inner diameter of a tube. Some features are designed to be about the same size as the outer diameter of a tube. Variations in dimensions are possible and intended to come within the scope of the invention, so long as the varied dimensions do not substantially compromise utility. The principles of the invention are not limited to pipes or tubes of any particular size.

Figure 1B:
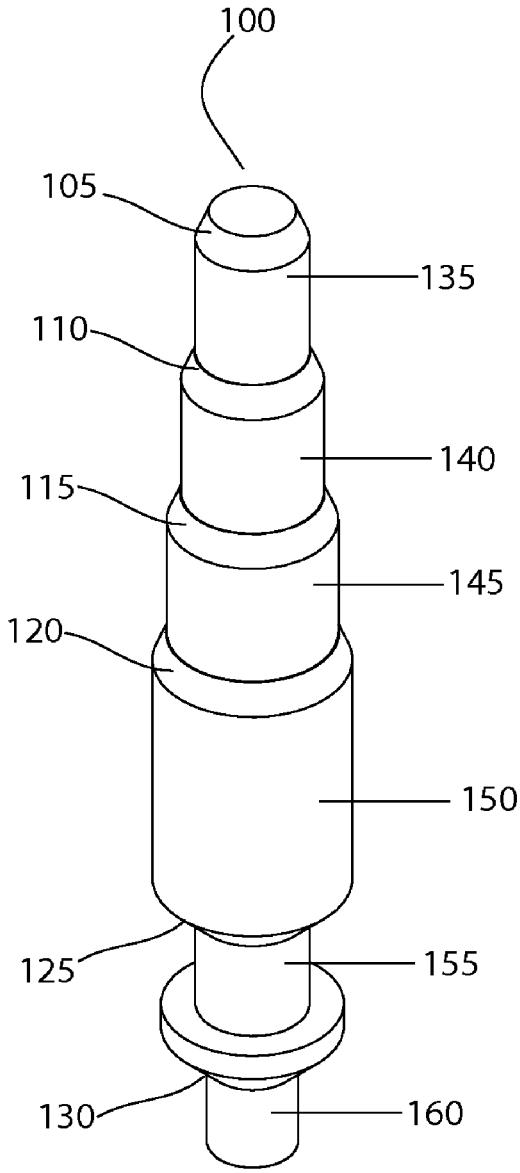
FIG. 1B shows a perspective view of the first exemplary pipe swedging tool for an air hammer according to principles of the invention.

Referring first to FIGS. 1A and 1B, profile and perspective views of a first exemplary pipe swedging tool 100 for an air hammer according to principles of the invention are provided. The tool 100 features three (3) swedging sections arranged in tandem. Each swedging section includes two adjacent body sections of different diameters and a tapered (chamfered) transition therebetween. Each body section is cylindrical with a diameter d and a length l. The first swedging section commences with a tapered (chamfered) leading edge 105 to facilitate entry into the interior of a tube. The angle $\alpha_{131}$ is obtuse, preferably (but not limited to) between 100 to 150°, and preferably 112°. The taper 105 provides a transition between the distal tip and the first body section 135. The first body section 135 has a diameter that is about equal or slightly smaller than the interior diameter of the smallest tubing for which the tool 100 is configured to swedge, such that the first body section 135 may fit (preferably snugly) within such tubing. By way of example and not limitation, the diameter of the first body section may equal or be about 0.5 inches and the length may equal or be about 0.75 inches. The first body section 135 terminates with a chamfered trailing edge 110 configured to provide a transition to the second body section 140. The second body section 140 has a diameter that is larger than the diameter of the second body section 140 and is approximately equal to or slightly larger than the outer diameter of the smallest tubing for which the tool 100 is configured to swedge. The length of the second body section 140 defines the length of the expanded section of tubing. Thus, when urged into the smallest tubing for which the tool 100 is configured to swedge, the first body section 135 slides into the tubing. As the tool 100 is urged further into the tubing and the free edge of the tubing encounters the chamfered trailing edge 110, the diameter of the engaged portion of the tubing is gradually expanded to the diameter of the second body section 140. Thus, the expanded diameter section of the tubing is configured to snugly receive a length of the undeformed smallest tubing for which the tool 100 is configured to swedge.

With further reference to FIGS. 1A and 1B, the second swedging section commences with a tapered (chamfered) edge 110 to facilitate entry into the interior of a tube. The angle $\alpha_{136}$ is obtuse, preferably (but not limited to) between 100 to 150°, and preferably 112°. The taper 110 provides a transition between the first body section 135 and the second body section 140. The second body section 140 has a diameter that is about equal or slightly smaller than the interior diameter of an intermediate-sized tubing for which the tool 100 is configured to swedge, such that the second body section 140 may fit (preferably snugly) within such tubing. By way of example and not limitation, the diameter of the second body section may equal or be about ⅝ inches and the length may equal or be about 0.75 inches. The second body section 140 terminates with a chamfered trailing edge 115 configured to provide a transition to the third body section 145. The third body section 145 has a diameter that is larger than the diameter of the second body section 140 and is approximately equal to or slightly larger than the outer diameter of the intermediate tubing for which the tool 100 is configured to swedge. The length of the third body section 145 defines the length of the expanded section of tubing. Thus, when urged into the intermediate tubing, the third body section 145 slides into the tubing. As the tool 100 is urged further into the tubing and the free edge of the tubing encounters the chamfered trailing edge 115, the diameter of the engaged portion of the tubing is gradually expanded to the diameter of the third body section 145. Thus, the expanded diameter section of the tubing is configured to snugly receive a length of the undeformed intermediate tubing for which the tool 100 is configured to swedge.

With further reference to FIGS. 1A and 1B, the third swedging section commences with a tapered (chamfered) edge 115 to facilitate entry into the interior of a tube. The angle $\alpha_{141}$ is obtuse, preferably (but not limited to) between 100 to 150°, and preferably 112°. The taper 115 provides a transition between the second body section 135 and the third body section 145. The third body section 145 has a diameter that is about equal or slightly smaller than the interior diameter of a large-sized tubing for which the tool 100 is configured to swedge, such that the third body section 145 may fit (preferably snugly) within such tubing. By way of example and not limitation, the diameter of the third body section may equal or be about 0.75 inches and the length may equal or be about 0.75 inches. The third body section 145 terminates with a chamfered trailing edge 120 configured to provide a transition to the fourth body section 150. The fourth body section 150 has a diameter that is larger than the diameter of the third body section 145 and is approximately equal to or slightly larger than the outer diameter of the large tubing for which the tool 100 is configured to swedge. The length of the fourth body section 150 defines the length of the expanded section of tubing. By way of example and not limitation, the diameter of the fourth body section may equal or be about ⅞ inches and the length may equal or be about 0.75 inches. Thus, when urged into the large tubing, the fourth body section 150 slides into the tubing. As the tool 100 is urged further into the tubing and the free edge of the tubing reaches the chamfered trailing edge 125, the diameter of the engaged portion of the tubing is gradually expanded to the diameter of the fourth body section 150. Thus, the expanded diameter section of the tubing is configured to snugly receive a length of the undeformed large tubing for which the tool 100 is configured to swedge.

The proximal end of the tool 100 comprises a shank configured for engagement by a powered impact tool, such as, but not limited to, an air powered impact hammer. The shank comprises a distal shank body 155 a retainer 130 and a proximal shank body 160. The retainer 130 is a flange configured for engagement by a spring retainer of an air hammer. The angle $\alpha_{151}$ of the chamfered transition is not particularly important. It may be between 90 and 150°. The proximal shank body 160 may be received and engaged by other retention means such as a collet or chuck. The diameter of the proximal shank body 160 may equal or be about, by way of example and not limitation, 0.40 inches. The diameter of the distal shank body 155 may equal or be about, by way of example and not limitation, 0.50 inches. Thus, the shank is configured for engagement by a spring retainer or other retention means of the powered impact tool.

A portable impact hammer drives the swedging tool into the tubing. The impact hammer is a portable percussive hammer powered by compressed gas or an electric motor. A typical pneumatic hammer generates roughly 2,000 to 5,000 blows per minute at 90 psi, with a stroke length of 1 to 2 inches, which is far greater than any force a human can manually exert. Additionally, the powered hammer exerts forces in a rapid, repeatable and consistent manner. The result is a consistent swedge or flare in minimal time, each time the tool is used.

Figure 2A:
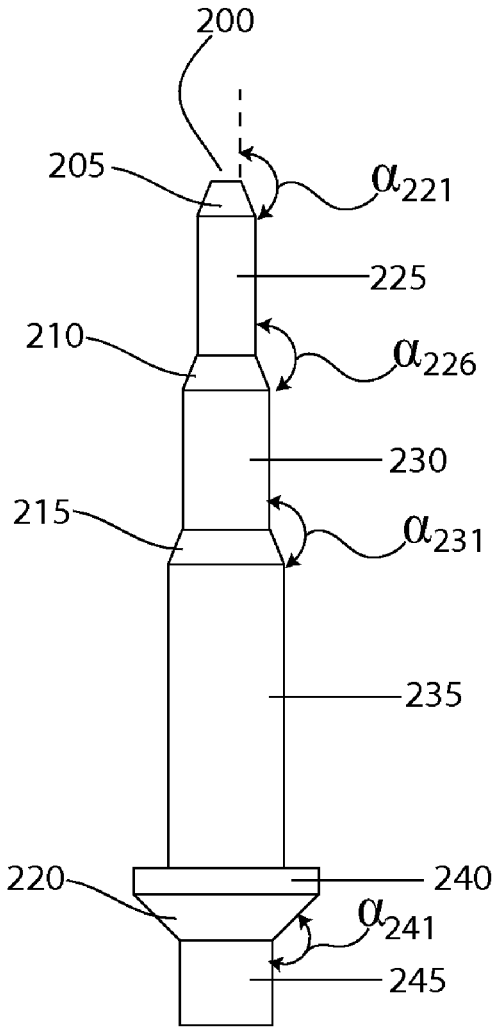
FIG. 2A shows a profile of a second exemplary pipe swedging tool for an air hammer according to principles of the invention.
Figure 2B:
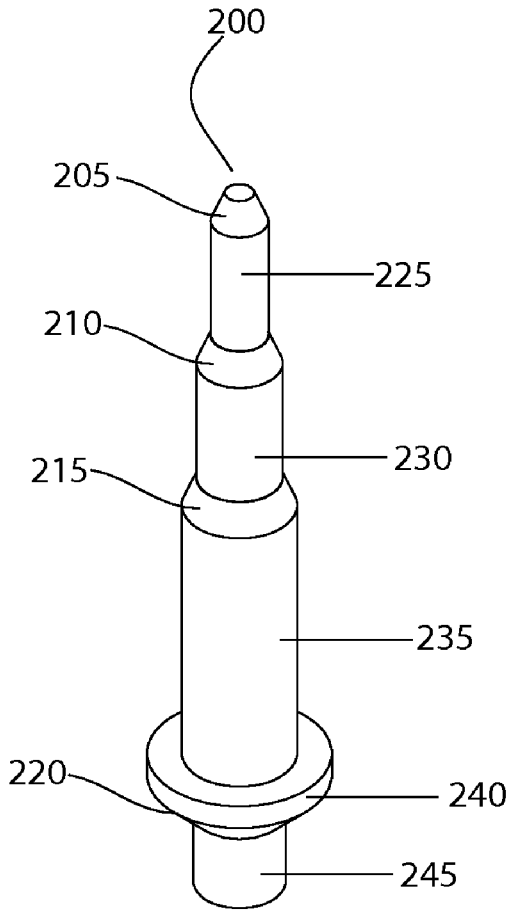
FIG. 2B shows a perspective view of the second exemplary pipe swedging tool for an air hammer according to principles of the invention.

Referring now to FIGS. 2A and 2 B, profile and perspective views of a second exemplary pipe swedging tool 200 for an air hammer according to principles of the invention are provided. The tool 200 features two (2) swedging sections arranged in tandem. Each swedging section includes two adjacent body sections of different diameters and a tapered (chamfered) transition therebetween. The first swedging section commences with a tapered (chamfered) leading edge 205 to facilitate entry into the interior of a tube. The angle $\alpha_{221}$ is obtuse, preferably (but not limited to) between 100 to 150°, and preferably 112°. The taper 205 provides a transition between the distal tip and the first body section 235. The first body section 235 has a diameter that is about equal or slightly smaller than the interior diameter of the smallest tubing for which the tool 200 is configured to swedge, such that the first body section 235 may fit (preferably snugly) within such tubing. By way of example and not limitation, the diameter of the first body section may equal or be about 0.25 inches and the length may equal or be about 0.75 inches. The first body section 225 terminates with a chamfered trailing edge 210 configured to provide a transition to the second body section 230. The second body section 230 has a diameter that is larger than the diameter of the second body section 230 and is approximately equal to or slightly larger than the outer diameter of the smallest tubing for which the tool 200 is configured to swedge. The length of the second body section 230 defines the length of the expanded section of tubing. By way of example and not limitation, the diameter of the second body section may equal or be about ⅜ inches and the length may equal or be about 0.75 inches. Thus, when urged into the smallest tubing for which the tool 200 is configured to swedge, the first body section 225 slides into the tubing. As the tool 200 is urged further into the tubing and the free edge of the tubing encounters the chamfered trailing edge 210, the diameter of the engaged portion of the tubing is gradually expanded to the diameter of the second body section 230. Thus, the expanded diameter section of the tubing is configured to snugly receive a length of the undeformed smallest tubing for which the tool 200 is configured to swedge.

With further reference to FIGS. 2A and 2 B, the second swedging section commences with a tapered (chamfered) edge 210 to facilitate entry into the interior of a tube. The angle $\alpha_{226}$ is obtuse, preferably (but not limited to) between 100 to 150°, and preferably 112°. The taper 210 provides a transition between the first body section 225 and the second body section 230. The second body section 230 has a diameter that is about equal or slightly smaller than the interior diameter of an intermediate-sized tubing for which the tool 200 is configured to swedge, such that the second body section 230 may fit (preferably snugly) within such tubing. The second body section 230 terminates with a chamfered trailing edge 215 configured to provide a transition to the third body section 235. The third body section 235 has a diameter that is larger than the diameter of the second body section 230 and is approximately equal to or slightly larger than the outer diameter of the intermediate tubing for which the tool 200 is configured to swedge. The length of the third body section 235 defines the length of the expanded section of tubing. By way of example and not limitation, the diameter of the third body section may equal or be about 0.5 inches and the length may equal or be about 1.5 inches. Thus, when urged into the intermediate tubing, the third body section 235 slides into the tubing. As the tool 200 is urged further into the tubing and the free edge of the tubing encounters the chamfered trailing edge 215, the diameter of the engaged portion of the tubing is gradually expanded to the diameter of the third body section 235. Thus, the expanded diameter section of the tubing is configured to snugly receive a length of the undeformed intermediate tubing for which the tool 200 is configured to swedge.

The proximal end of the tool 200 comprises a shank configured for engagement by a powered impact tool, such as, but not limited to, an air powered impact hammer. The shank comprises a distal shank body 235 a retainer 220 and a proximal shank body 245. The retainer 220 acts as a flange configured for engagement by a spring retainer of an air hammer. The angle $\alpha_{241}$ of the chamfered transition is not particularly important. It may be between 90 and 150°. The proximal shank body 245 may be received and engaged by other retention means such as a collet or chuck. The diameter of the proximal shank body 245 may equal or be about, by way of example and not limitation, 0.40 inches. The diameter of the distal shank body 235 may equal or be about, by way of example and not limitation, 0.50 inches. Thus, the shank is configured for engagement by a spring retainer or other retention means of the powered impact tool.

A portable impact hammer drives the swedging tool into the tubing. The impact hammer is a portable percussive hammer powered by compressed gas or an electric motor. A typical pneumatic hammer generates roughly 2,000 to 5,000 blows per minute at 90 psi, with a stroke length of 1 to 2 inches, which is far greater than any force a human can manually exert. Additionally, the powered hammer exerts forces in a rapid, repeatable and consistent manner. The result is a consistent swedge or flare in minimal time, each time the tool is used.

Figure 3A:
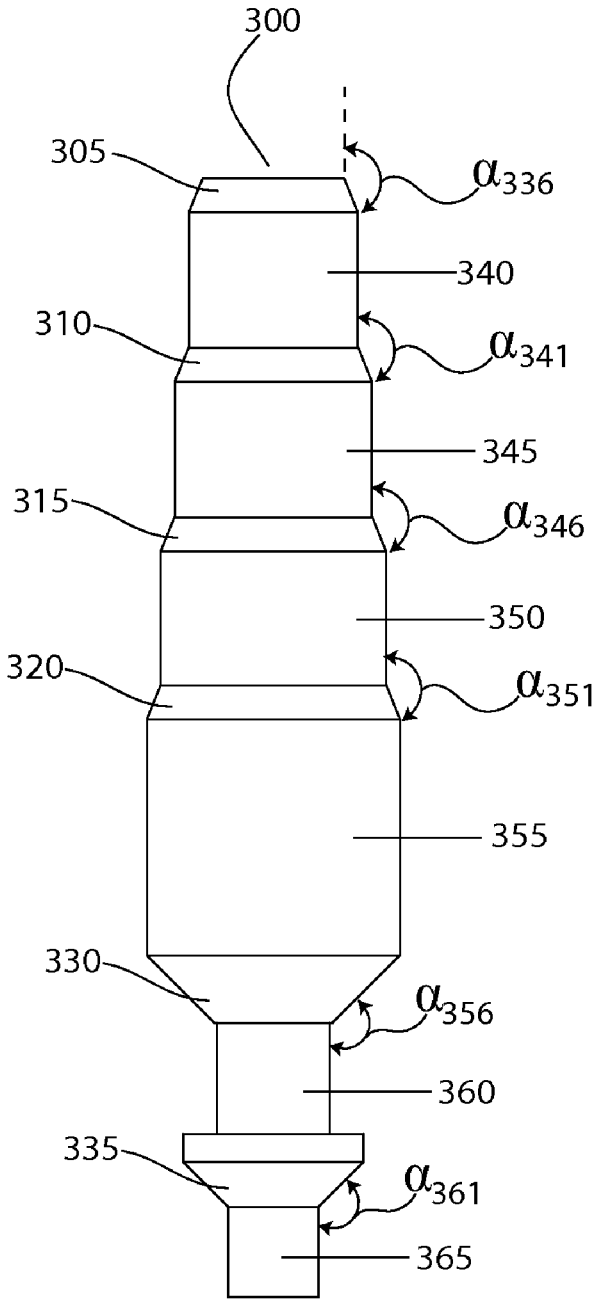
FIG. 3A shows a profile of a third exemplary pipe swedging tool for an air hammer according to principles of the invention.
Figure 3B:
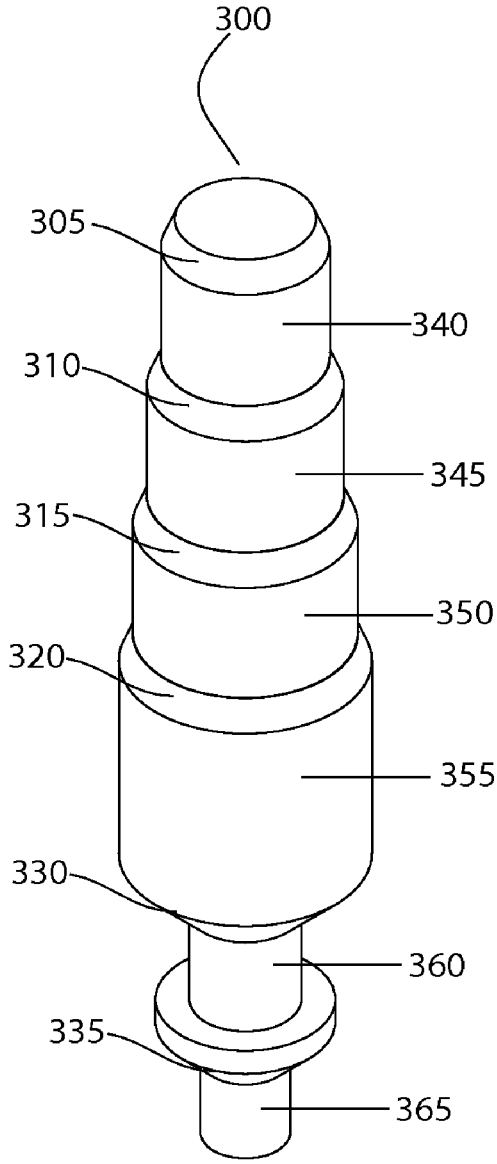
FIG. 3B shows a perspective view of the third exemplary pipe swedging tool for an air hammer according to principles of the invention.

Referring now to FIGS. 3A and 3B, profile and perspective views of a first exemplary pipe swedging tool 300 for an air hammer according to principles of the invention are provided. The tool 300 features three (3) swedging sections arranged in tandem. Each swedging section includes two adjacent body sections of different diameters and a tapered (chamfered) transition therebetween. The first swedging section commences with a tapered (chamfered) leading edge 305 to facilitate entry into the interior of a tube. The angle $\alpha$336 is obtuse, preferably (but not limited to) between 100 to 150°, and preferably 112°. The taper 305 provides a transition between the distal tip and the first body section 340. The first body section 340 has a diameter that is about equal or slightly smaller than the interior diameter of the smallest tubing for which the tool 300 is configured to swedge, such that the first body section 340 may fit (preferably snugly) within such tubing. By way of example and not limitation, the diameter of the first body section may equal or be about 0.75 inches and the length may equal or be about 0.75 inches. The first body section 340 terminates with a chamfered trailing edge 310 configured to provide a transition to the second body section 345. The second body section 345 has a diameter that is larger than the diameter of the second body section 345 and is approximately equal to or slightly larger than the outer diameter of the smallest tubing for which the tool 300 is configured to swedge. The length of the second body section 345 defines the length of the expanded section of tubing. Thus, when urged into the smallest tubing for which the tool 300 is configured to swedge, the first body section 340 slides into the tubing. As the tool 300 is urged further into the tubing and the free edge of the tubing encounters the chamfered trailing edge 310, the diameter of the engaged portion of the tubing is gradually expanded to the diameter of the second body section 345. Thus, the expanded diameter section of the tubing is configured to snugly receive a length of the undeformed smallest tubing for which the tool 300 is configured to swedge.

With further reference to FIGS. 3A and 3B, the second swedging section commences with a tapered (chamfered) edge 310 to facilitate entry into the interior of a tube. The angle $\alpha_{341}$ is obtuse, preferably (but not limited to) between 100 to 150°, and preferably 112°. The taper 310 provides a transition between the first body section 340 and the second body section 345. The second body section 345 has a diameter that is about equal or slightly smaller than the interior diameter of an intermediate-sized tubing for which the tool 300 is configured to swedge, such that the second body section 345 may fit (preferably snugly) within such tubing. By way of example and not limitation, the diameter of the second body section may equal or be about ⅞ inches and the length may equal or be about 0.75 inches. The second body section 345 terminates with a chamfered trailing edge 315 configured to provide a transition to the third body section 350. The third body section 350 has a diameter that is larger than the diameter of the second body section 345 and is approximately equal to or slightly larger than the outer diameter of the intermediate tubing for which the tool 300 is configured to swedge. The length of the third body section 350 defines the length of the expanded section of tubing. Thus, when urged into the intermediate tubing, the third body section 350 slides into the tubing. As the tool 300 is urged further into the tubing and the free edge of the tubing encounters the chamfered trailing edge 315, the diameter of the engaged portion of the tubing is gradually expanded to the diameter of the third body section 350. Thus, the expanded diameter section of the tubing is configured to snugly receive a length of the undeformed intermediate tubing for which the tool 300 is configured to swedge.

With further reference to FIGS. 3A and 3B, the third swedging section commences with a tapered (chamfered) edge 315 to facilitate entry into the interior of a tube. The angle $\alpha_{346}$ is obtuse, preferably (but not limited to) between 100 to 150°, and preferably 112°. The taper 315 provides a transition between the second body section 340 and the third body section 350. The third body section 350 has a diameter that is about equal or slightly smaller than the interior diameter of a large-sized tubing for which the tool 300 is configured to swedge, such that the third body section 350 may fit (preferably snugly) within such tubing. By way of example and not limitation, the diameter of the third body section may be 1 inch and the length may equal or be about 0.75 inches. The third body section 350 terminates with a chamfered trailing edge 320 configured to provide a transition to the fourth body section 355. The fourth body section 355 has a diameter that is larger than the diameter of the third body section 350 and is approximately equal to or slightly larger than the outer diameter of the large tubing for which the tool 300 is configured to swedge. The length of the fourth body section 355 defines the length of the expanded section of tubing. By way of example and not limitation, the diameter of the fourth body section may equal or be about 1.125 inches and the length may equal or be about 0.75 inches. Thus, when urged into the large tubing, the fourth body section 355 slides into the tubing. As the tool 300 is urged further into the tubing and the free edge of the tubing reaches the chamfered trailing edge 330, the diameter of the engaged portion of the tubing is gradually expanded to the diameter of the fourth body section 355. Thus, the expanded diameter section of the tubing is configured to snugly receive a length of the undeformed large tubing for which the tool 300 is configured to swedge.

The proximal end of the tool 300 comprises a shank configured for engagement by a powered impact tool, such as, but not limited to, an air powered impact hammer. The shank comprises a distal shank body 360 a retainer 335 and a proximal shank body 365. The angle $\alpha_{361}$ of the chamfered transition is not particularly important. It may be between 90 and 150°. The retainer 335 acts as a flange configured for engagement by a spring retainer of an air hammer. The proximal shank body 365 may be received and engaged by other retention means such as a collet or chuck. The diameter of the proximal shank body 365 may equal or be about, by way of example and not limitation, 0.40 inches. The diameter of the distal shank body 360 may equal or be about, by way of example and not limitation, 0.50 inches. Thus, the shank is configured for engagement by a spring retainer or other retention means of the powered impact tool.

A portable impact hammer drives the swedging tool into the tubing. The impact hammer is a portable percussive hammer powered by compressed gas or an electric motor. A typical pneumatic hammer generates roughly 2,000 to 5,000 blows per minute at 90 psi, with a stroke length of 1 to 2 inches, which is far greater than any force a human can manually exert. Additionally, the powered hammer exerts forces in a rapid, repeatable and consistent manner. The result is a consistent swedge or flare in minimal time, each time the tool is used.

Figure 4A:
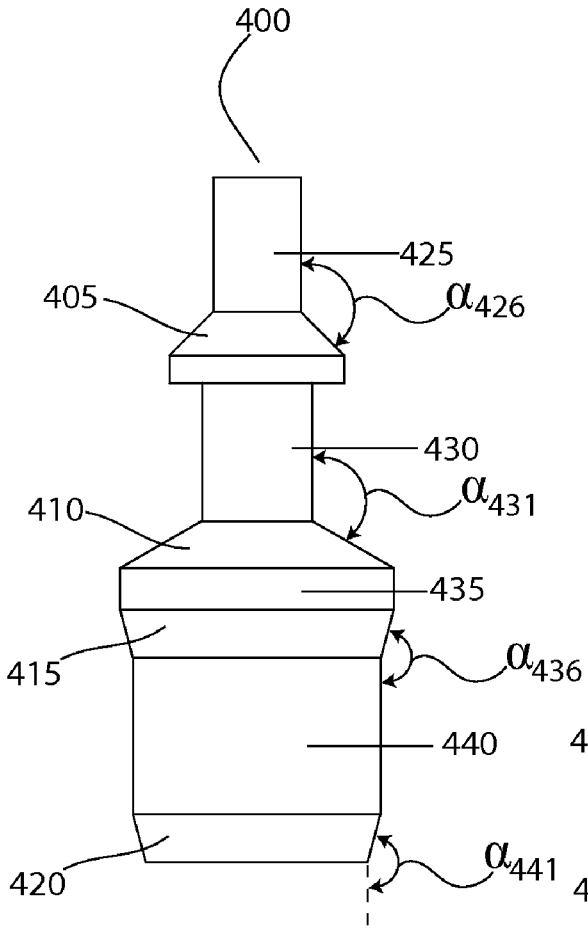
FIG. 4A shows a profile of a first exemplary pipe flaring tool for an air hammer according to principles of the invention.
Figure 4B:
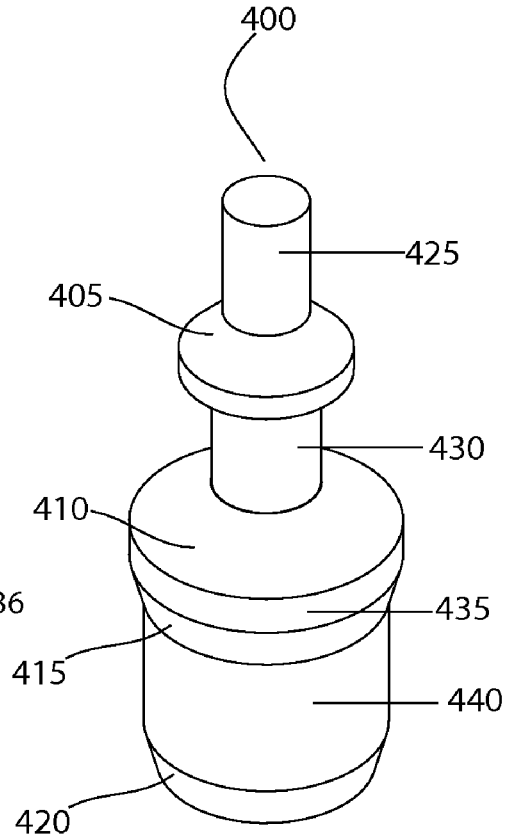
FIG. 4B shows a perspective view of the first exemplary pipe flaring tool for an air hammer according to principles of the invention.

Referring now to FIGS. 4A and 4B, profile and perspective views of a first exemplary pipe flaring tool 400 for an air hammer according to principles of the invention are provided. The tool 400 features one (1) flaring section comprising a body section and a tapered (chamfered) trailing edge. The flaring section commences with a tapered (chamfered) leading edge 420 to facilitate entry into the interior of a tube. The angle $\alpha_{441}$ is obtuse, preferably (but not limited to) between 100 to 150°, and preferably 135°. The taper 420 provides a transition between the distal tip and the first body section 440. The body section 440 has a diameter that is about equal or slightly smaller than the interior diameter of the smallest tubing for which the tool 400 is configured to flare, such that the first body section 440 may fit (preferably snugly) within such tubing. By way of example and not limitation, the diameter of the body section may equal or be about ¼, ⅜, ½, ⅝, ¾, ⅞, 1 or 1.125 inches and the length may equal or be about 0.75 inches. The body section 440 terminates with a chamfered trailing edge 415 configured to create a flare in the workpiece. Thus, when urged into the smallest tubing for which the tool 400 is configured to flare, the body section 440 slides into the tubing. As the tool 400 is urged further into the tubing and the free edge of the tubing encounters the chamfered trailing edge 415, the edge of the tubing is gradually expanded or flared.

The chamfered trailing edges transitions to an intermediate section 435 followed by a chamfered transition 410 to a shank. The angle $\alpha_{431}$ of the chamfered transition is not particularly important. It may be between 90 and 150°.

The proximal end of the tool 400 comprises a shank configured for engagement by a powered impact tool, such as, but not limited to, an air powered impact hammer. The shank comprises a distal shank body 440 a retainer 405 and a proximal shank body 425. The retainer 405 acts as a flange configured for engagement by a spring retainer of an air hammer. The angle $\alpha_{426}$ of the chamfered transition is not particularly important. It may be between 90 and 150°. The proximal shank body 425 may be received and engaged by other retention means such as a collet or chuck. The diameter of the proximal shank body 425 may equal or be about, by way of example and not limitation, 0.40 inches. The diameter of the distal shank body 440 may equal or be about, by way of example and not limitation, 0.50 inches. Thus, the shank is configured for engagement by a spring retainer or other retention means of the powered impact tool.

A portable impact hammer drives the flaring tool into the tubing. The impact hammer is a portable percussive hammer powered by compressed gas or an electric motor. A typical pneumatic hammer generates roughly 2,000 to 5,000 blows per minute at 90 psi, with a stroke length of 1 to 2 inches, which is far greater than any force a human can manually exert. Additionally, the powered hammer exerts forces in a rapid, repeatable and consistent manner. The result is a consistent flare or flare in minimal time, each time the tool is used.

Figure 5A:
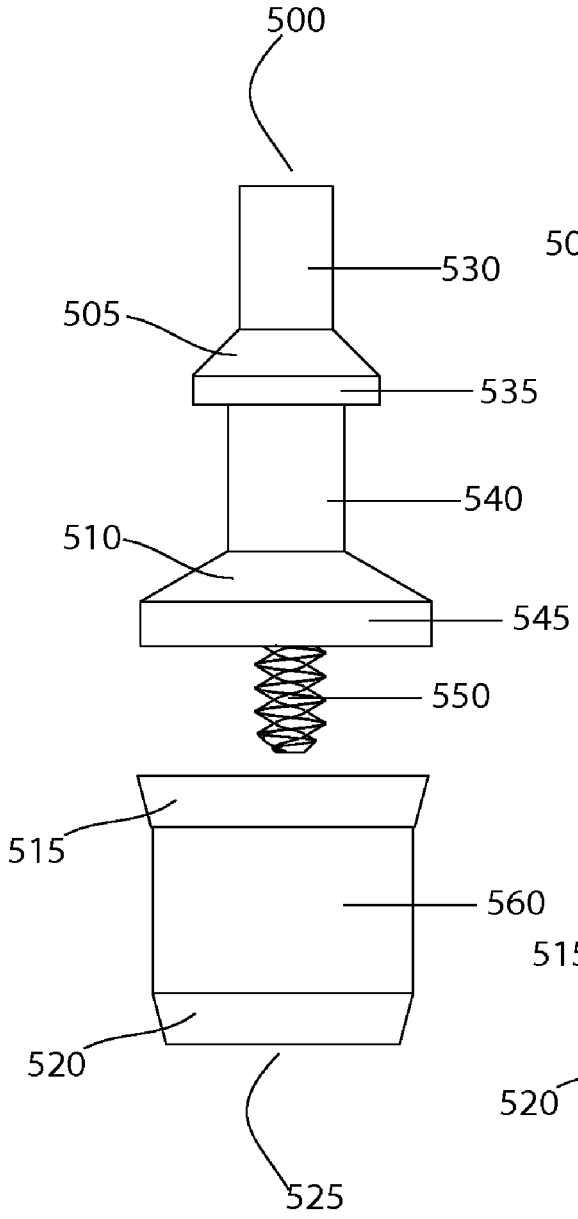
FIG. 5A shows a profile of the first exemplary pipe flaring tool with an optional threaded coupling for an air hammer according to principles of the invention.
Figure 5B:
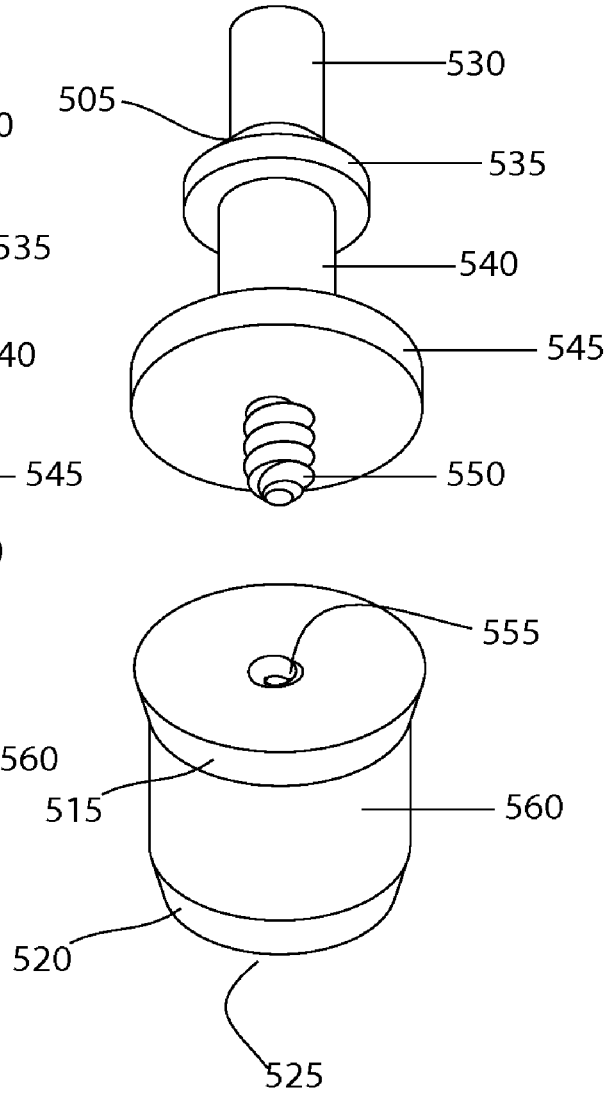
FIG. 5B shows a perspective view of the first exemplary pipe flaring tool with an optional threaded coupling for an air hammer according to principles of the invention.

Referring now to FIGS. 5A and 5B, profile and perspective views of an alternative embodiment of the first exemplary pipe flaring tool 400 for an air hammer according to principles of the invention are provided. The tool 400 features one (1) flaring section comprising two adjacent body sections of different diameters and a tapered (chamfered) transition therebetween releasably attachable to a shank section by a threaded male 550 and female 555 attachment. Those skilled in the art will appreciate that any sections of any of the swedging and flaring tool embodiments may similarly be releasably attachable. Thus, damaged sections may be replaced without discarding undamaged sections. Unneeded sections may be removed to shorten the overall length. The tool may be custom configured to serve the particular needs of a worker or project.

Figure 6:
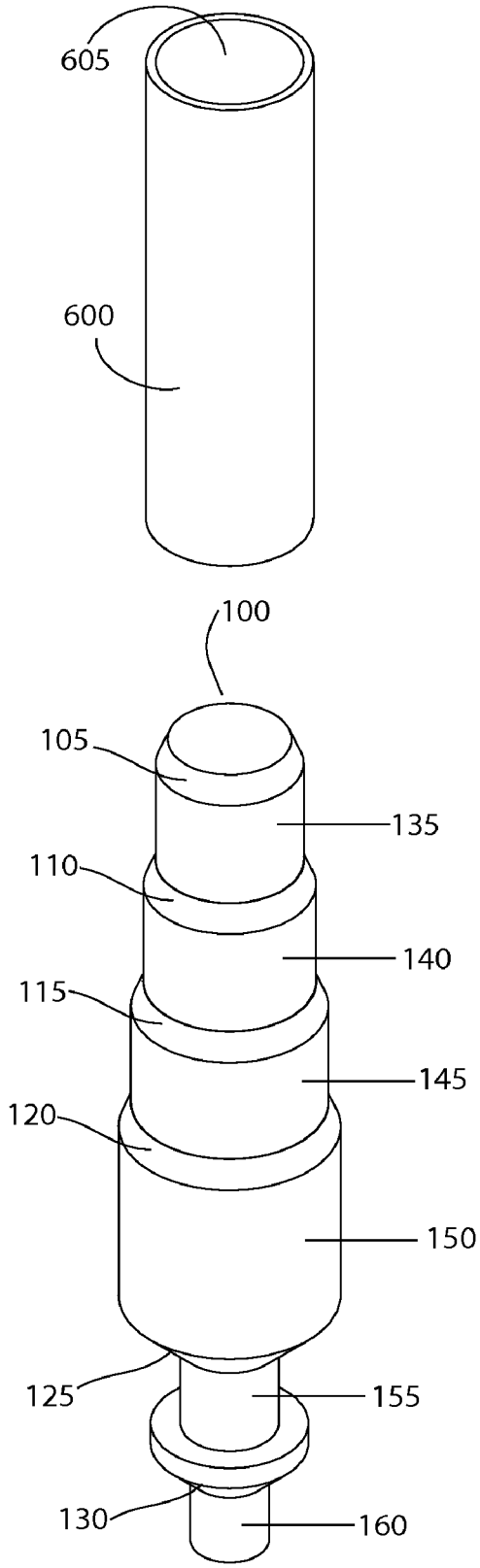
FIG. 6 shows a perspective view of the first exemplary pipe swedging tool for an air hammer with an exemplary workpiece according to principles of the invention.
Figure 7A:
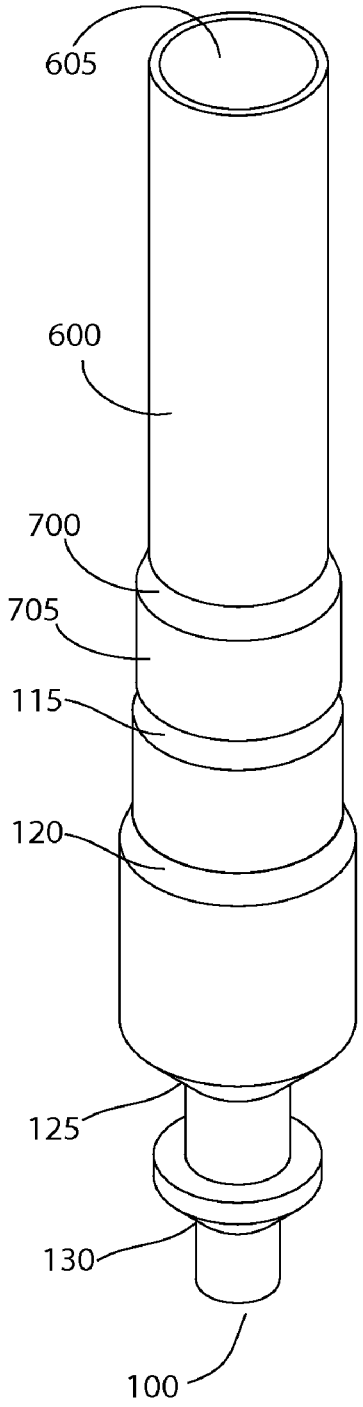
FIG. 7A shows a perspective view of the first exemplary pipe swedging tool for an air hammer with an exemplary swedged workpiece according to principles of the invention.
Figure 7B:
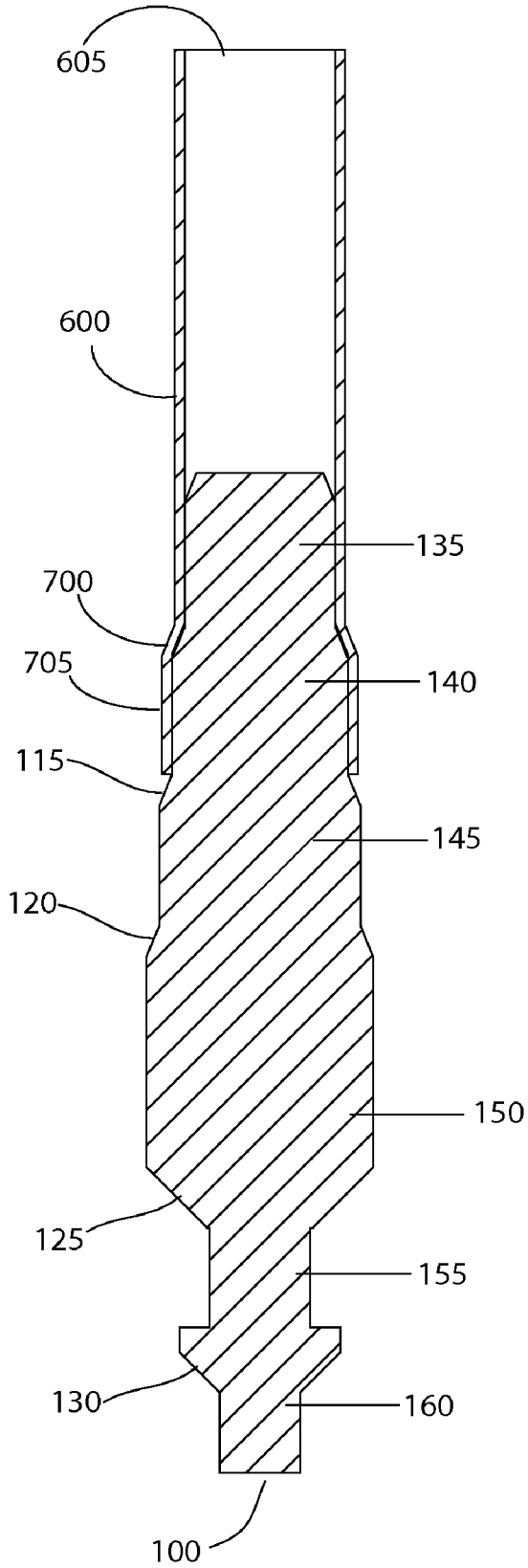
FIG. 7B shows a section view of the first exemplary pipe swedging tool for an air hammer with an exemplary swedged workpiece according to principles of the invention.
Figure 8A:
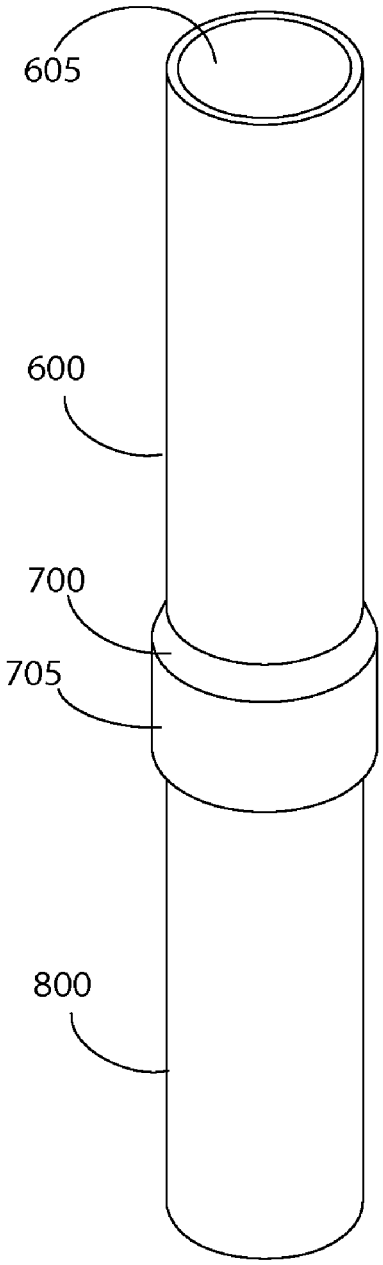
FIG. 8A shows a perspective view of an exemplary length of tubing fitted into a swedged workpiece according to principles of the invention.
Figure 8B:
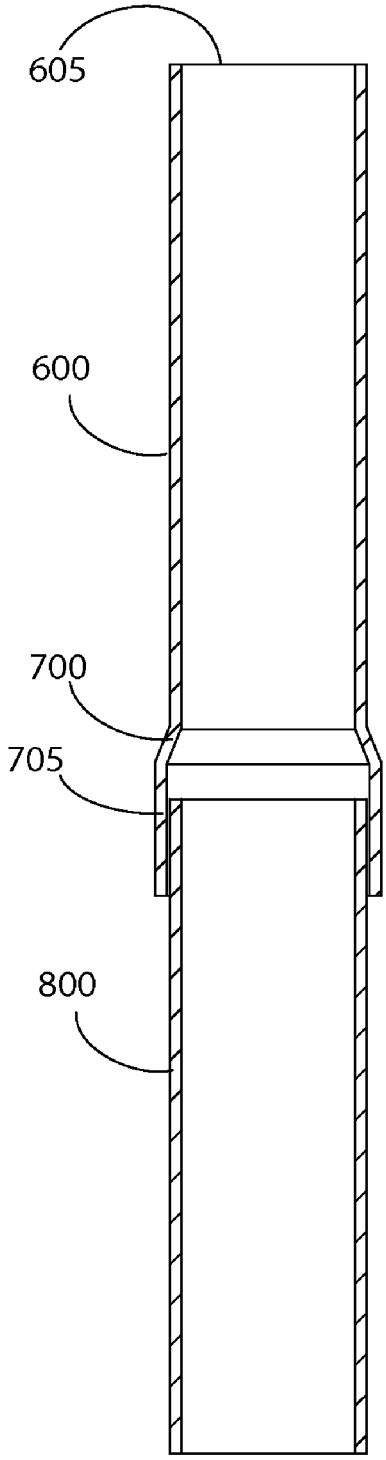
FIG. 8B shows a section view of an exemplary length of tubing fitted into a swedged workpiece according to principles of the invention.

Referring now to FIGS. 6, 7A, 7B, 8A and 8B, profile and perspective views of the first exemplary pipe swedging tool 100 for an air hammer along with a length of tubing in various stages of swedging according to principles of the invention are provided. The tool 100 features three (3) swedging sections arranged in tandem. Each swedging section includes two adjacent body sections of different diameters and a tapered (chamfered) transition therebetween. A length of undeformed tubing 600 with a central channel 605 is shown in FIG. 6. The inner diameter of the tubing 600 is the same as or slightly larger than the first body section 135, so that the tubing 600 may easily slip onto the tool 100. Using a power tool such as a pneumatic impact hammer, the tool 100 is driven into the tubing 600 until the free edge of the tubing 600 reaches chamfered trailing edge 115, as shown in FIGS. 7A and 7B. The tubing may be clamped or otherwise held in place as the tool is driven therein. At that point, an expanded section 705 and a gradual transition 700 to the undisturbed original diameter have been formed. The inner diameter of the expanded section 705 is equal to the outer diameter of the tubing 600. Thus, after removing the swedged piece 600, a similar undeformed tubing section 800 may be inserted snugly into the expanded section 705, as shown in FIGS. 8A and 8B. The joint may then be heated using a torch and solder may be melted into the connection. When the solder cools, it forms a very strong bond. Advantageously, only one edge of the joint has to be soldered.

Figure 9:
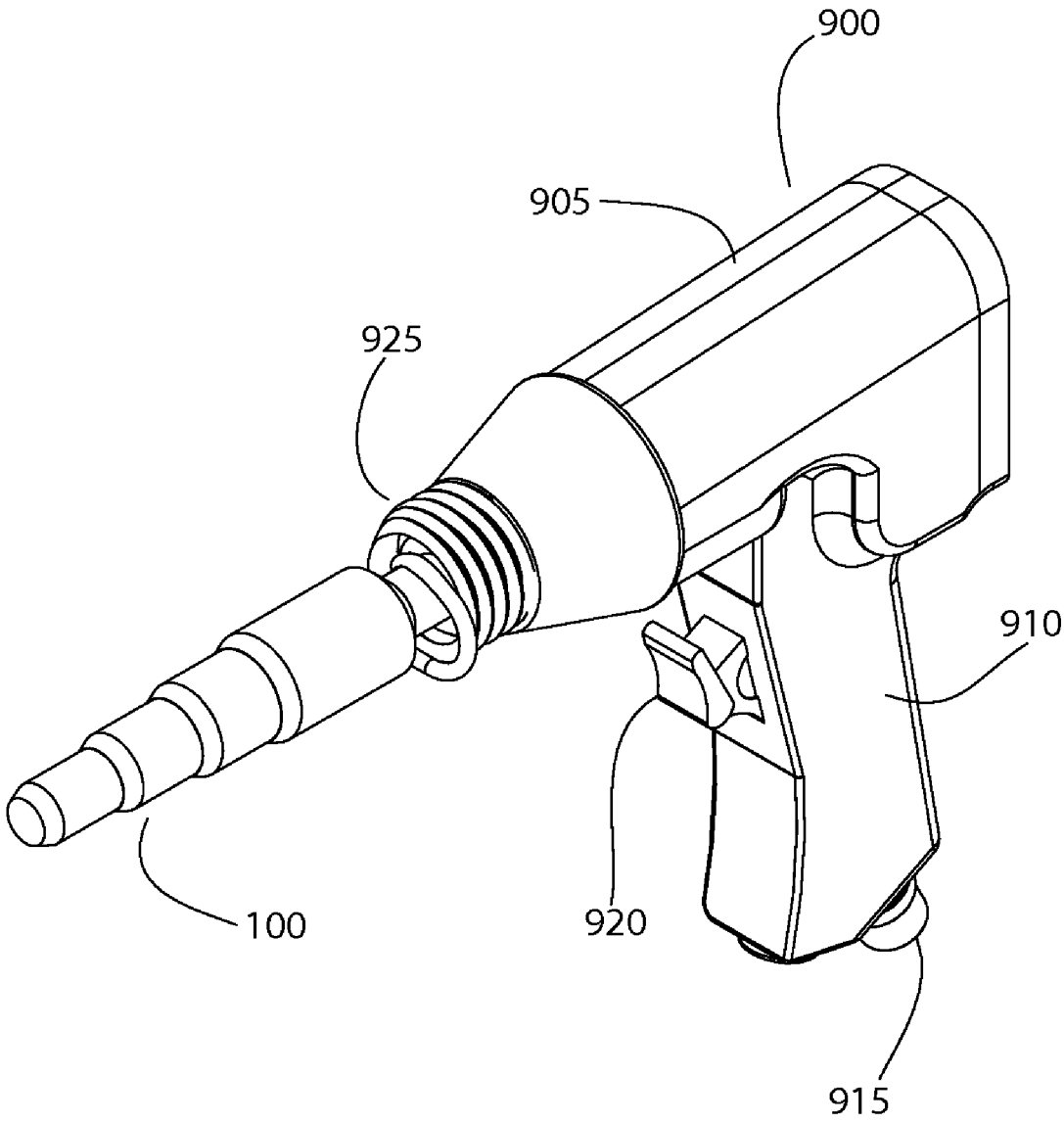
FIG. 9 shows a perspective view of the first exemplary pipe swedging tool installed on an exemplary air hammer according to principles of the invention.

FIG. 9 illustrates a pneumatic device 900 of the conventional type normally found in automobile service stations and garages. The device includes a handle 910, a body portion 905 and an actuating means or trigger 920 for activating the hammer, and an inlet 915 for coupling the device to an air supply line. A typical air hammer delivers about 2000 to 5000 blows per minute, weighs approximately 3 to 5 pounds and measures 8 to 10 inches over all. Threadedly attached to the distal end of the device is a conventional spring retainer element 925 which engages and holds the various flange-shanked tools of this invention. As is well known in the art, the spring retainer element has a tightly wound helical portion having a tang extending outwardly from the helix at a tangent and having a bight portion on its distal end to facilitate engagement with a finger or thumb.

Figure 10:
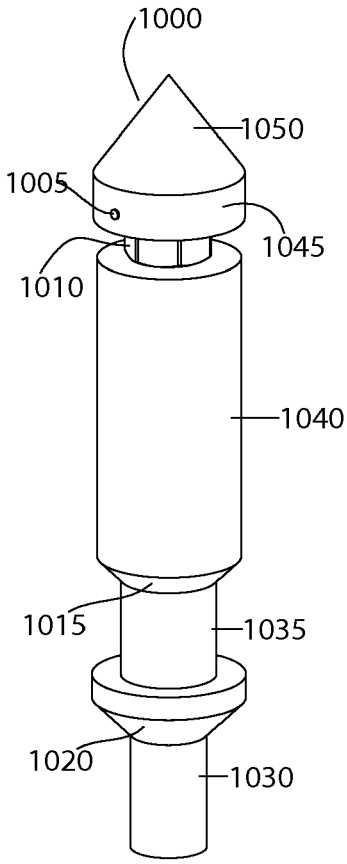
FIG. 10 shows a perspective view of a second exemplary pipe flaring tool with a removable flaring head and a shank coupling for an air hammer according to principles of the invention.
Figure 11:
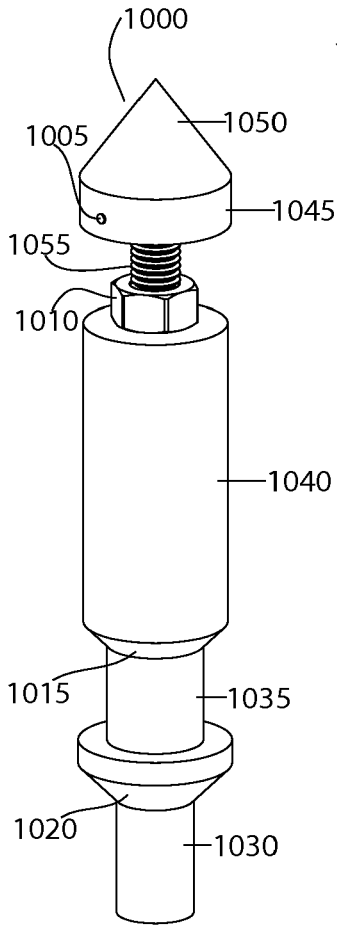
FIG. 11 shows another perspective view of a second exemplary pipe flaring tool with a removable flaring head in an extended position and a shank coupling for an air hammer according to principles of the invention.
Figure 12:
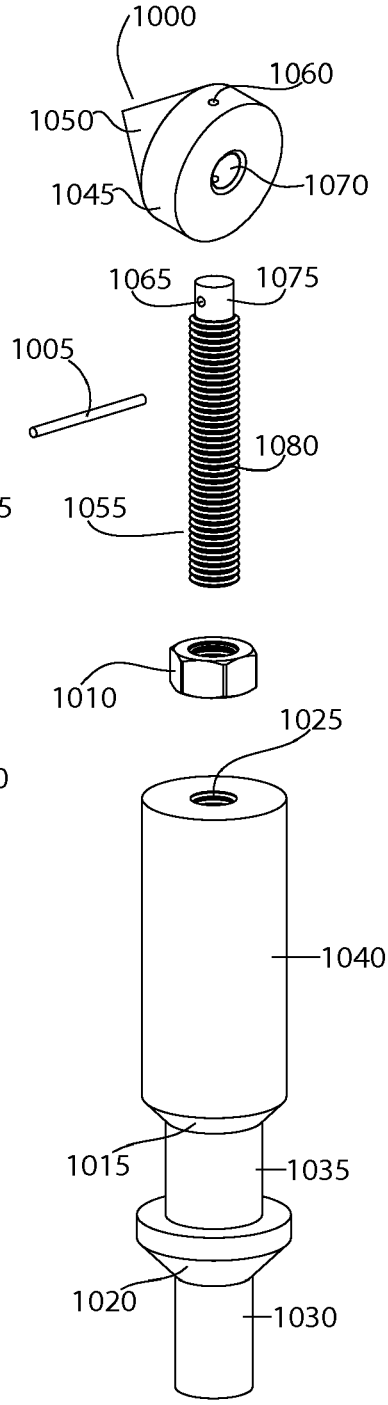
FIG. 12 shows a perspective exploded view of a second exemplary pipe flaring tool with a removable flaring head and a shank coupling for an air hammer according to principles of the invention.

Referring now to FIGS. 10, 11 and 12, perspective views of a second exemplary pipe flaring tool with a removable flaring head and a shank coupling for an air hammer according to principles of the invention are shown. The tool 1000 features a flaring section comprising a conical body section 1050 and a cylindrical skirt 1045. The conical flaring section 1050 facilitates entry into the interior of any tubes having an interior diameter smaller than the base diameter of the cone. The cylindrical skirt 1045 provides a transition between the flaring head and a threaded coupling 1055. The external threads 1080 of the threaded coupling 1055 are threadedly received by corresponding internal threads 1025 of the cylindrical body 1040. A lock nut 1010, which can be tightened against the cylindrical body 1040, prevents the threaded coupling 1055 from working loose from the cylindrical body 1040. A neck 1075 of the threaded coupling 1055 has a channel 1065 (or other mating feature) for receiving a fastening pin 1005 (or other fastener). The neck 1075 is received in a socket 1070 in the cylindrical skirt 1045. The channel 1070 in the neck 1075 aligns with a channel through the cylindrical skirt 1045, when the neck 1075 is received in a socket 1070 in the cylindrical skirt 1045 and the neck 1075 is oriented relative to the cylindrical skirt 1045 for alignment. A fastening pin may be pressed into the channel 1060 of the cylindrical skirt 1045 as well as the aligned channel 1065 of the neck 1075, thereby fastening the flaring head to the threaded coupling 1055. The distance between the flaring head and the cylindrical body 1040 may readily be adjusted by turning the threaded coupling 1055 relative to the threaded body 1040. Additionally, the flaring head may be replaced with an alternative flaring head, swedging head or other impact driven pipe fitting die in accordance with principles of the invention. The cylindrical body 1040 terminates with a chamfered trailing edge 1015 which transitions to the proximal end of the tool 100 comprising a shank configured for engagement by a powered impact tool, such as, but not limited to, an air powered impact hammer.

The shank comprises a distal shank body 1035 a retainer 1020 and a proximal shank body 1030. The retainer 1020 acts as a flange configured for engagement by a spring retainer of an air hammer. The proximal shank body 1030 may be received and engaged by other retention means such as a collet or chuck. The diameter of the proximal shank body 1030 may equal or be about, by way of example and not limitation, 0.40 inches. The diameter of the distal shank body 1035 may equal or be about, by way of example and not limitation, 0.50 inches. Thus, the shank is configured for engagement by a spring retainer or other retention means of the powered impact tool.

A portable impact hammer drives the flaring tool into the tubing. The impact hammer is a portable percussive hammer powered by compressed gas or an electric motor. A typical pneumatic hammer generates roughly 2,000 to 5,000 blows per minute at 90 psi, with a stroke length of 1 to 2 inches, which is far greater than any force a human can manually exert. Additionally, the powered hammer exerts forces in a rapid, repeatable and consistent manner. The result is a consistent flare or flare in minimal time, each time the tool is used.

Flaring and swedging tools in accordance with principles of the invention are not limited to use with any tools for clamping and securing tubing sections. Flaring and swedging tools in accordance with principles of the invention may be used with any tools for clamping and securing tubing sections. Flaring and swedging tools in accordance with principles of the invention may also be used without any tools for clamping and securing tubing sections, such as by hand holding the tubing sections or by flaring or swedging exposed sections of installed tubing.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A swedging tool for expanding an end of a first metal tube having a first inner diameter and a first outer diameter and an end of a second metal tube having a second inner diameter and a second outer diameter comprising a swedging body having a die section for expanding the first metal tube when driven thereinto; and a flanged shank attached to said swedging body and configured for engagement by a powered impact hammer, said die section comprising:

a cylindrical first body section having a diameter that is equal to the first inner diameter of the first metal tube, and a cylindrical second body section having a diameter that is equal to the first outer diameter the first metal tube, and a first chamfered transition from said first body section to said second body section, and a cylindrical third body section having a diameter that is about equal to the second outer diameter of the second metal tube, and said cylindrical second body section having a diameter that is about equal to the second inner diameter the second metal tube, and a second chamfered transition from said second body section to said third body section.

2. A swedging tool according to claim 1, said flanged shank being configured for engagement by a retainer spring of a powered impact hammer.

3. A swedging tool according to claim 2, said flanged shank having a cylindrical proximal shank body sized for engagement by a powered impact hammer, a distal shank body, and a flange disposed therebetween.

4. A swedging tool according to claim 3, said flange having a chamfered trailing edge and a leading edge substantially perpendicular to a longitudinal axis of the swedging tool.

5. A swedging tool according to claim 4, said proximal shank body having a diameter of about 0.40 inches.

6. A swedging tool according to claim 4, said distal shank body having a diameter of about 0.50 inches.

7. A swedging tool according to claim 4, said flange having a diameter of about 0.80 inches.

8. A swedging tool according to claim 4, said proximal shank body having a diameter of about 0.40 inches and said distal shank body having a diameter of about 0.50 inches.

9. A swedging tool according to claim 4, said proximal shank body having a diameter of about 0.40 inches and said distal shank body having a diameter of about 0.50 inches, and said flange having a diameter of about 0.80 inches.

10. A swedging tool according to claim 1, said flanged shank being threadedly connected to the swedging body.

11. A swedging tool according to claim 1, said flanged shank being integrally formed and permanently connected to the swedging body.

12. A swedging tool according to claim 1, said swedging tool being further configured to expand an end of a third metal tube having a third inner diameter and a third outer diameter, said die section further comprising a cylindrical fourth body section having a diameter that is about equal to the third outer diameter of the third metal tube, and said cylindrical third body section having a diameter that is about equal to the third inner diameter the third metal tube, and a third chamfered transition from said third body section to said fourth body section.

* * * * *